US007243394B2

(12) United States Patent
Kao

(10) Patent No.: US 7,243,394 B2
(45) Date of Patent: Jul. 17, 2007

(54) DOOR CLOSING HINGE DEVICE

(76) Inventor: Ching Chih Kao, No. 100, Suwang Road, Dali City, Taichung 41258 (TW)

( * ) Notice: Subject to any disclaimer, the term of this patent is extended or adjusted under 35 U.S.C. 154(b) by 209 days.

(21) Appl. No.: 11/063,423

(22) Filed: Feb. 22, 2005

(65) Prior Publication Data

US 2006/0230573 A1 Oct. 19, 2006

(51) Int. Cl.
*E05F 3/20* (2006.01)

(52) U.S. Cl. ..... 16/50; 16/284; 16/54

(58) Field of Classification Search ..... 16/50, 16/54, 280–284, 285, 303, 330, 55, 68, 72, 16/76, 312

See application file for complete search history.

(56) References Cited

U.S. PATENT DOCUMENTS

| | | | | | |
|---|---|---|---|---|---|
| 2,685,102 | A | * | 8/1954 | Forkey | 16/284 |
| 3,518,716 | A | * | 7/1970 | Larson | 16/284 |
| 4,215,449 | A | * | 8/1980 | Loikitz | 16/50 |
| 4,631,777 | A | * | 12/1986 | Takimoto | 16/315 |
| 4,756,051 | A | | 7/1988 | Shy | 16/50 |
| 5,048,155 | A | | 9/1991 | Hwang | 16/301 |
| 5,398,378 | A | * | 3/1995 | Lin | 16/303 |
| 5,682,644 | A | * | 11/1997 | Bohacik et al. | 16/284 |
| 6,658,694 | B2 | * | 12/2003 | Wang | 16/50 |

FOREIGN PATENT DOCUMENTS

| | | | |
|---|---|---|---|
| DE | 2645627 | A | * 4/1978 |
| GB | 2281099 | A | * 2/1995 |
| JP | 04118486 | A | * 4/1992 |
| JP | 11343769 | A | * 12/1999 |
| JP | 2003082924 | A | * 3/2003 |
| JP | 2003232162 | A | * 8/2003 |

* cited by examiner

*Primary Examiner*—Chuck Y. Mah
(74) *Attorney, Agent, or Firm*—Charles E. Baxley

(57) ABSTRACT

A door closing hinge device includes two flaps for attaching to a door frame and a door panel, a seat and a housing attached to the flaps. A follower is slidably disposed in the housing, and includes an inclined surface for engaging with an inclined surface of the seat, and for moving the follower up and down relative to the housing when the follower and the housing are rotated relative to the seat. A guiding device may guide the follower to move up and down relative to the housing, and a forcing device may force the follower and the door panel to rotate relative to the door frame back to an original position where the inclined surfaces of the seat and the follower are engaged with each other.

10 Claims, 8 Drawing Sheets

DOOR CLOSING HINGE DEVICE

BACKGROUND OF THE INVENTION

1. Field of the Invention

The present invention relates to a door closing hinge device, and more particularly to a door closing hinge device having an automatically returning or recovering structure.

2. Description of the Prior Art

Typical door closing hinges comprise two flaps for securing to the door panel and the door frame respectively, and one or more spring members engaged between the flaps, for applying a spring biasing force between the flaps, and for closing the door panel automatically after the door panel has been opened.

For example, U.S. Pat. No. 4,756,051 to Shy discloses one of the typical door-closer hinge devices and also comprises two flaps for securing to the door panel and the door frame respectively, and an automatic closer including a longitudinal casing secured to one of the flaps. A rotor vane is fixed on a rotor and received in a cylinder which is filled with a hydraulic oil, to form a rotary shock absorber for quickly opening a door.

However, the hydraulic oil is incompressible, such that one or more complicated fluid flowing passages are required to be formed or provided within the casing and the other elements or parts, such that the typical door-closer hinge device comprises a complicated structure or figuration that may not be easily manufactured or machined and assembled.

U.S. Pat. No. 5,048,155 to Hwang discloses another typical door closing spring hinge device which also comprises two flaps for securing to the door panel and the door frame respectively, and a spring member engaged between the flaps, for applying a spring biasing force between the flaps, and for closing the door panel automatically after the door panel has been opened.

However, the spring member is normally a torsional spring and will be seriously distorted or twisted every time when the door is opened and closed, such that the torsional spring will be easily damaged after use.

The present invention has arisen to mitigate and/or obviate the afore-described disadvantages of the conventional door closing hinge devices.

SUMMARY OF THE INVENTION

The primary objective of the present invention is to provide a door closing hinge device including an automatically returning or recovering structure.

In accordance with one aspect of the invention, there is provided a door closing hinge device comprising a first flap and a second flap for attaching to a door frame and a door panel respectively, a seat attached to the first flap and including an inclined surface provided on top thereof, a housing attached to the second flap and including a chamber formed therein, a follower slidably disposed in the chamber of the housing, and including an inclined surface provided on bottom thereof, for engaging with the inclined surface of the seat, and for moving the follower up and down relative to the housing when the follower and the housing are rotated relative to the seat, a guiding device for guiding the follower to move up and down relative to the housing and to prevent the follower from being rotated relative to the housing, and a forcing device for forcing the follower and the housing and the door panel to rotate relative to the door frame and the first flap back to an original position where the inclined surfaces of the seat and the follower are engaged with each other.

The guiding device includes at least one groove formed in the housing, and includes at least one projection extended from the follower and slidably engaged in the groove of the housing. The guiding device further includes an anchor member slidably disposed in the housing and having the projection extended therefrom, and the follower includes a stem extended therefrom and engaged with the anchor member, to anchor the follower to the anchor member, and to allow the follower and the anchor member to be rotated in concert with each other.

The anchor member includes a non-circular orifice formed therein, and the stem of the follower includes a non-circular cross section to engage into corresponding non-circular orifice of the anchor member, to anchor or to attach the follower to the anchor member.

The first flap includes a base attached thereto, and disposed and engaged with bottom of the housing, and arranged to allow the housing to be rotated relative to the base when the door panel is rotated relative to the door frame. The base includes a non-circular aperture formed therein, the seat includes a non-circular stem extended downwardly therefrom, engaged into the non-circular aperture of the base, to anchor the stem and the seat to the base and the first flap, and to prevent the seat from being rotated relative to the base and the first flap.

The seat includes a peripheral wall having a bore formed therein and having the inclined surface provided on top thereof, and includes a swelling extended in the bore thereof and located within the peripheral wall thereof, and the follower includes a peripheral wall having a bore formed therein and having the inclined surface provided on bottom thereof, and includes a protrusion extended in the bore thereof and located within the peripheral wall thereof for engaging with the swelling of the seat.

The swelling of the seat includes an inclined surface provided on top thereof, and the protrusion of the follower also include an inclined surface provided on bottom thereof, for engaging with the inclined surface of the swelling of the seat.

The forcing device include a casing secured in the housing, a rod slidably and rotatably received in the casing and having a lower end secured to the follower, to allow the rod to be moved up and down or in and out of the casing by the follower. The rod includes a piston secured on top thereof and slidably engaged in an inner chamber of the casing for pressing air received in the casing. The casing includes at least one gasket disposed therein, to enclose the inner chamber of the casing, and to slidably receive the rod, and thus to allow the piston to compress the air received within the inner chamber of the casing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
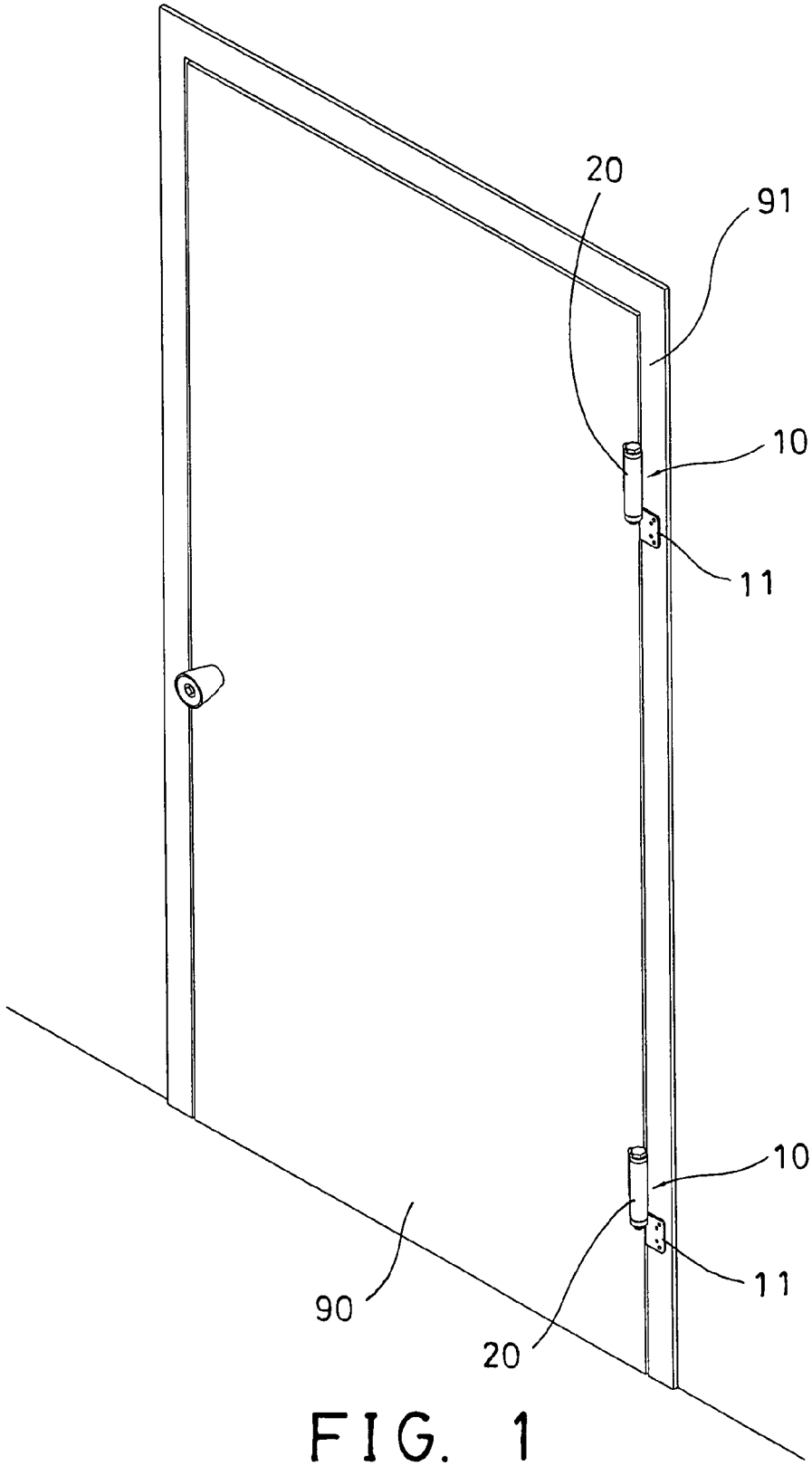
FIG. 1 is a perspective view illustrating an attachment of a door closing hinge device in accordance with the present invention to a door panel.
Figure 2:
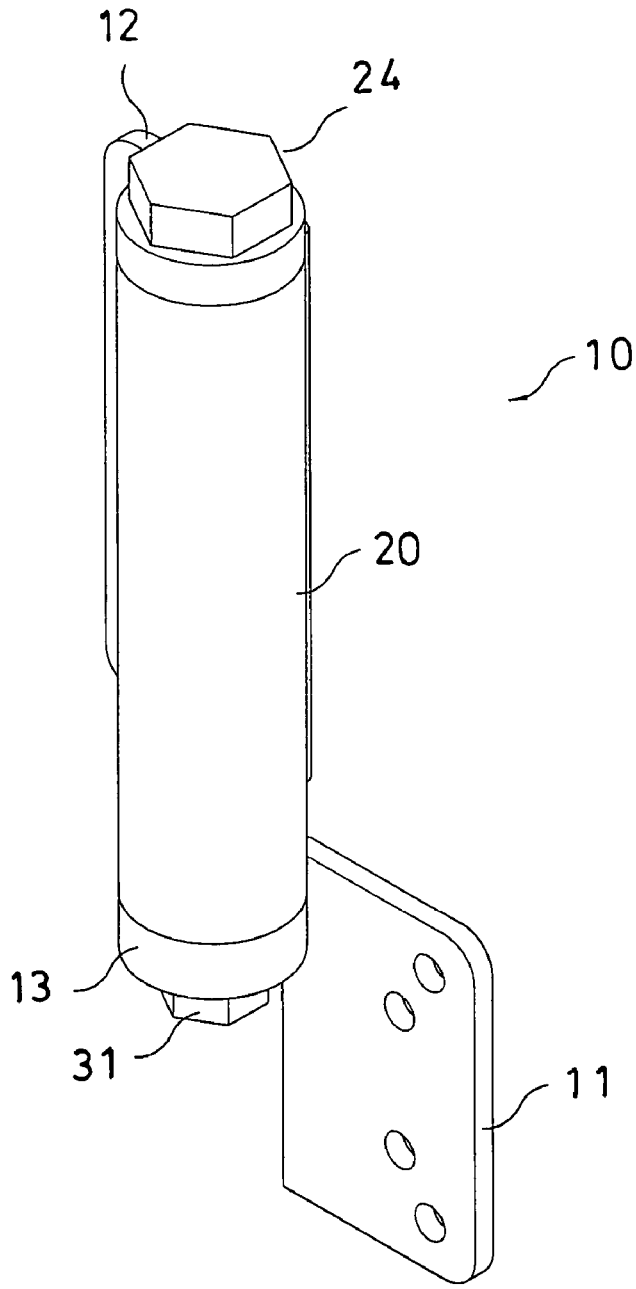
FIG. 2 is a perspective view of the door closing hinge device.

Referring to the drawings, and initially to FIGS. 1-6, a door closing hinge device 10 in accordance with the present invention comprises a flap 11 for securing to a door frame 91 or a door panel 90, and another flap 12 for securing to the door panel 90 or the door frame 91, and an outer housing 20 secured to one of the flaps 11, 12, such as the flap 12 that may be secured to either the door panel 90 or the door frame 91. The housing 20 includes a chamber 21 formed therein, and one or more longitudinal grooves 22 formed therein and communicating with the chamber 21 thereof.

The housing 20 includes an outer thread 23 formed in the outer peripheral portion thereof, for threading with a cap 24 which may enclose the chamber 21 of the housing 20. The flap 11 includes a base 13 attached thereto or extended therefrom and having a non-circular aperture 14 formed therein. The base 13 is disposed or engaged with bottom of the outer housing 20, and arranged to allow the outer housing 20 to be rotated relative to the base 13, when the door panel 90 is rotated relative to the door frame 91.

A seat 30 is disposed on the base 13, and includes a non-circular stem 31 extended downwardly therefrom, for engaging into the corresponding non-circular aperture 14 of the base 13 or of the flap 11, to anchor the stem 31 and thus the seat 30 to the base 13 and the flap 11, and to prevent the seat 30 from being rotated relative to the base 13 and the flap 11. The seat 30 includes a peripheral wall 32 having a bore 33 formed therein and having an inclined surface 34 formed and provided on top thereof.

Figure 3:
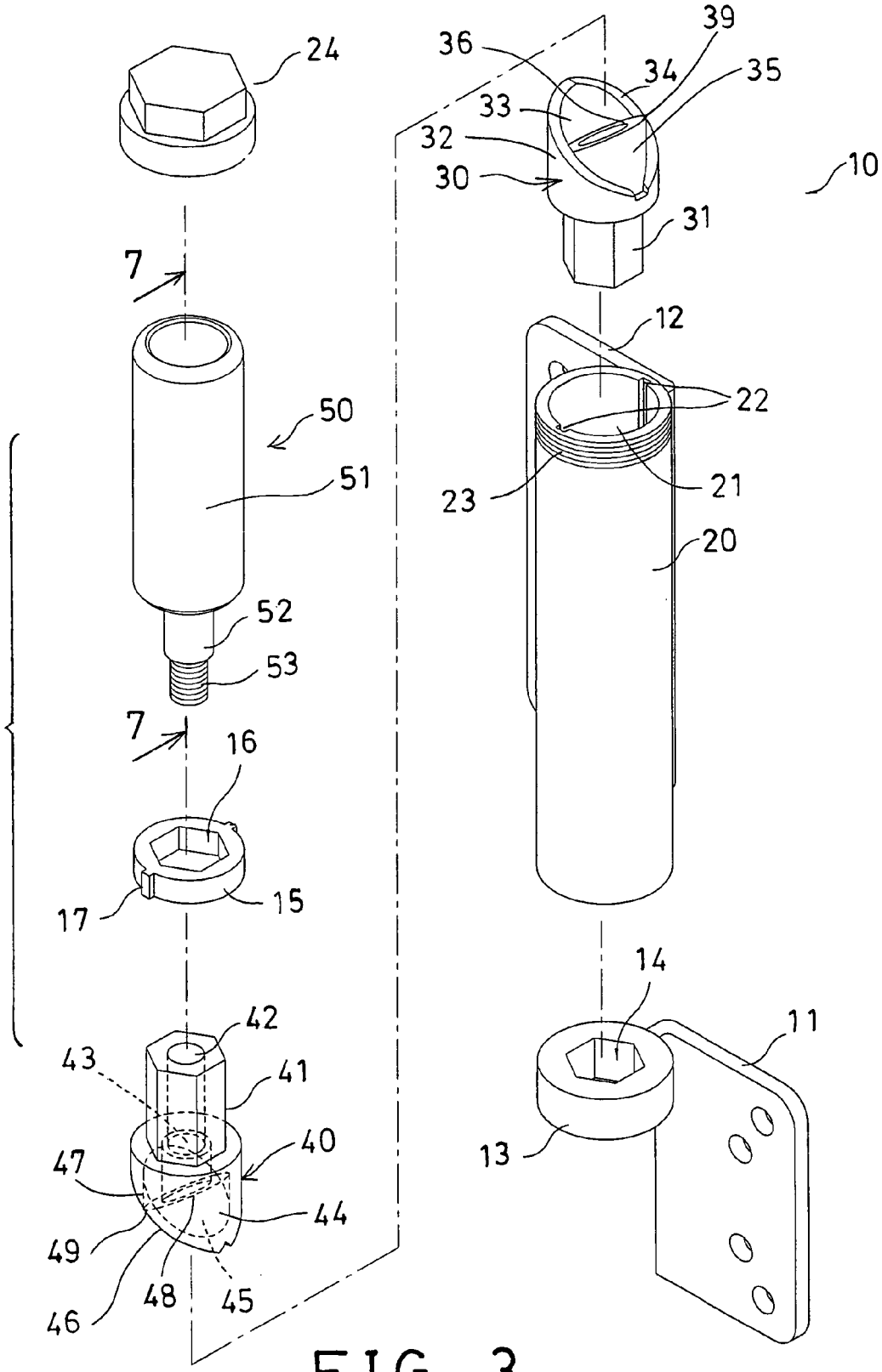
FIG. 3 is a partial exploded view of the door closing hinge device.
Figure 5:
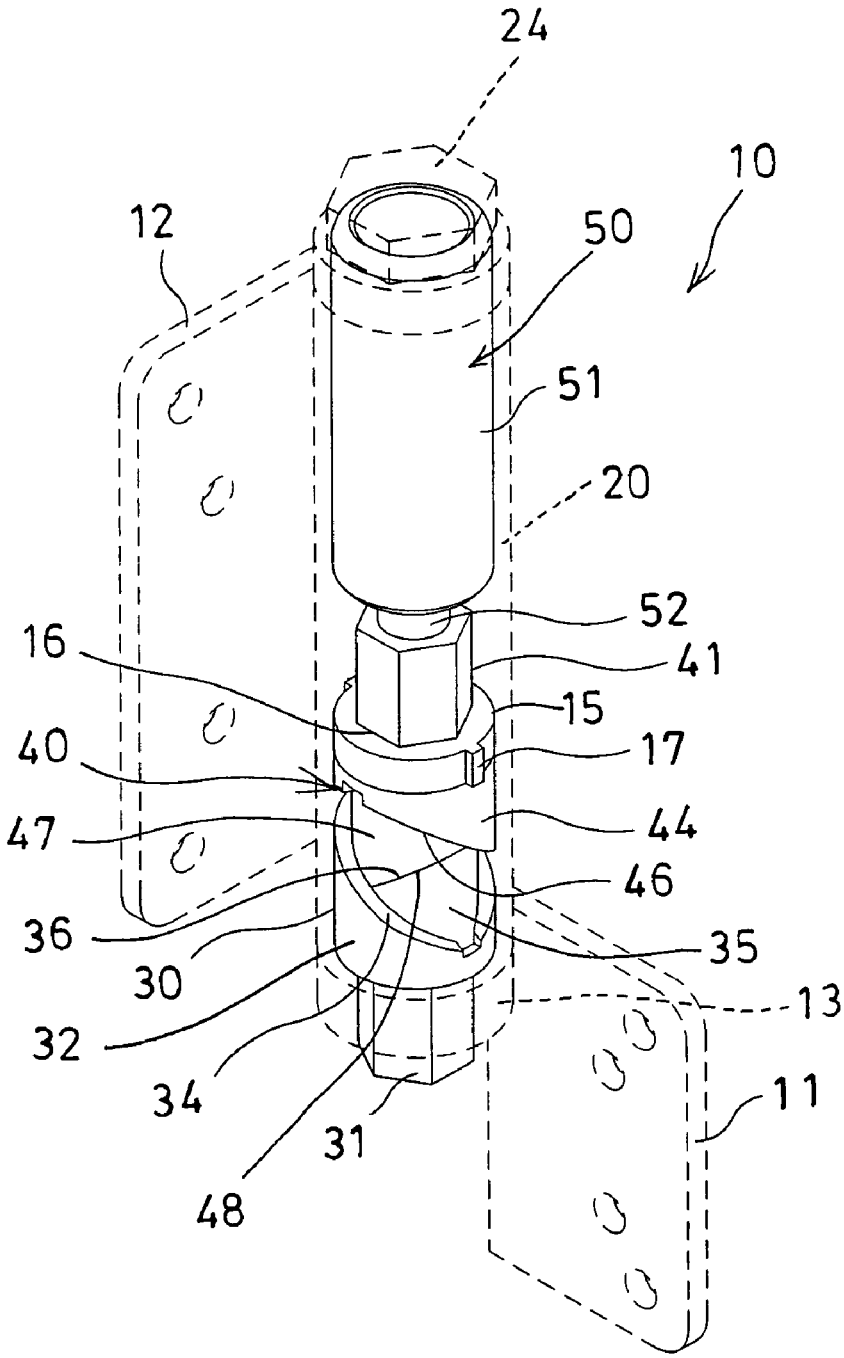
FIG. 5 is a perspective view similar to FIG. 4, illustrating the operation of the door closing hinge device.
Figure 6:
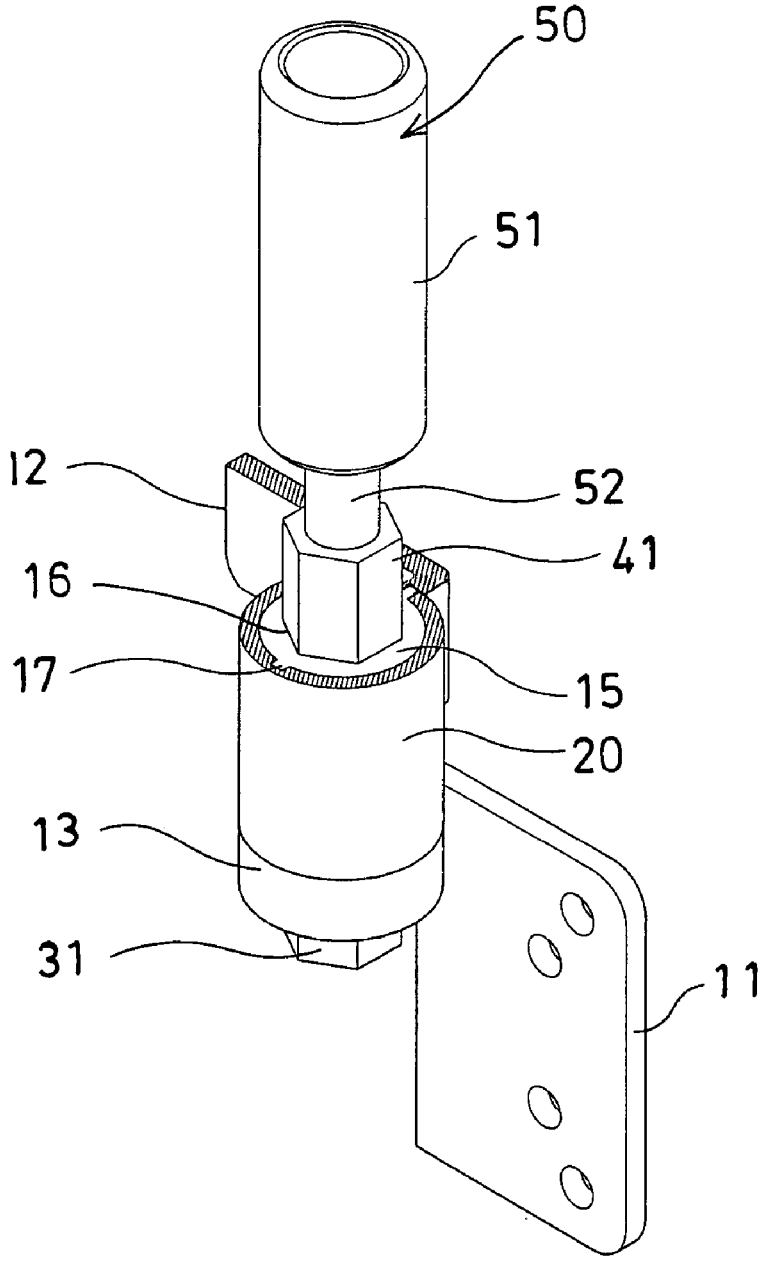
FIG. 6 is a perspective view similar to FIG. 2, in which the outer housing has been partially cut off to show an inner structure of the door closing hinge device.
Figure 8:
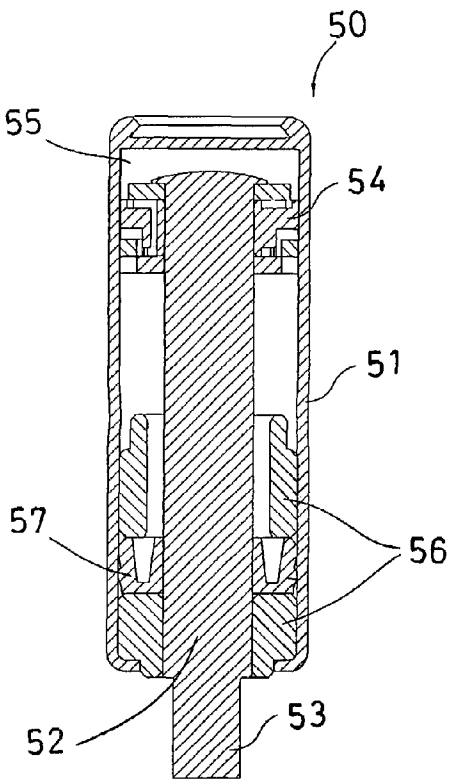
FIG. 8 is a cross sectional view similar to FIG. 7, illustrating the operation of the door closing hinge device.
Figure 7:
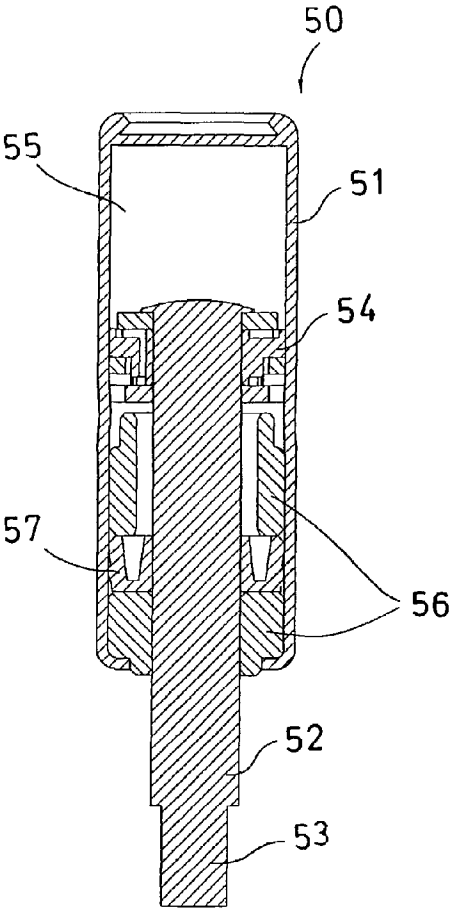
FIG. 7 is a cross sectional view of a pneumatic recovering device, taken along lines 7-7 of FIG. 3.
Figure 9:
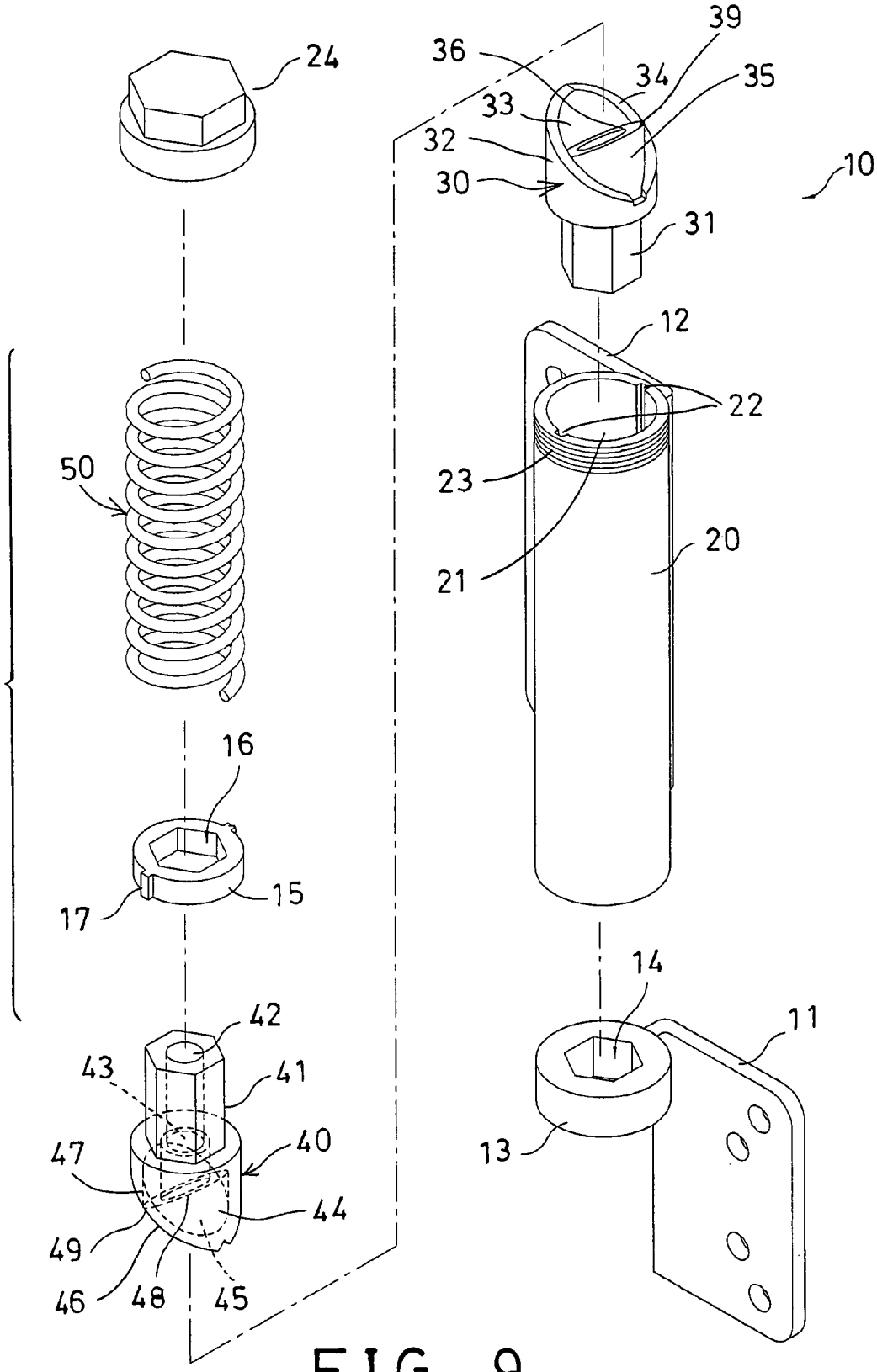
FIG. 9 is a partial exploded view similar to FIG. 3, illustrating the other arrangement of the door closing hinge device.

The seat 30 may further include a swelling 35 extended in the bore 33 thereof and located within the peripheral wall 32 thereof, and the swelling 35 may also include an inclined surface 36 formed and provided on top thereof. It is preferable that the inclined surfaces 34 and 36 of the seat 30 and the swelling 35 are inclined or facing toward different directions, and may have an included angle formed therebetween (FIGS. 3, 5, 9).

An anchor member 15 is slidably disposed in the housing 20, and includes a non-circular orifice 16 formed therein, and includes one or more keys or projections 17 extended outwardly therefrom, for slidably engaging into the corresponding longitudinal grooves 22 of the housing 20, to guide the anchor member 15 to move up and down along the housing 20, and to prevent the anchor member 15 from being rotated relative to the housing 20.

A follower 40 is disposed in the housing 20, and includes a non-circular stem 41 extended upwardly therefrom, for engaging into the corresponding non-circular orifice 16 of the anchor member 15, to anchor the follower 40 to the anchor member 15, and thus to allow the follower 40 and the anchor member 15 to be rotated in concert with each other, and to guide the anchor member 15 and the follower 40 to move up and down along the housing 20, and to prevent the anchor member 15 and thus the follower 40 from being rotated relative to the housing 20.

Alternatively, the anchor member 15 and the follower 40 may be formed as a one-integral-piece, and may have the projections 17 directly extended from the follower 40 and slidably engaged into the corresponding longitudinal grooves 22 of the housing 20. The projections 17 of the follower 40 and the corresponding longitudinal grooves 22 of the housing 20 may thus be formed as a guiding means to guide the follower 40 to move up and down relative to the housing 20, and to prevent the follower 40 from being rotated relative to the housing 20.

The follower 40 includes a passage 42 formed therein, and an inner thread 43 formed in an inner portion thereof (FIGS. 3, 9), and also includes a peripheral wall 44 having a bore 45 formed therein and having an inclined surface 46 formed and provided on bottom thereof, for engaging with the inclined surface 34 of the seat 30. The follower 40 may further include a protrusion 47 extended in the bore 45 thereof and located within the peripheral wall 44 thereof, and the protrusion 47 may also include an inclined surface 48 formed and provided on bottom thereof, for engaging with the inclined surface 36 of the swelling 35 of the seat 30.

Figure 4:
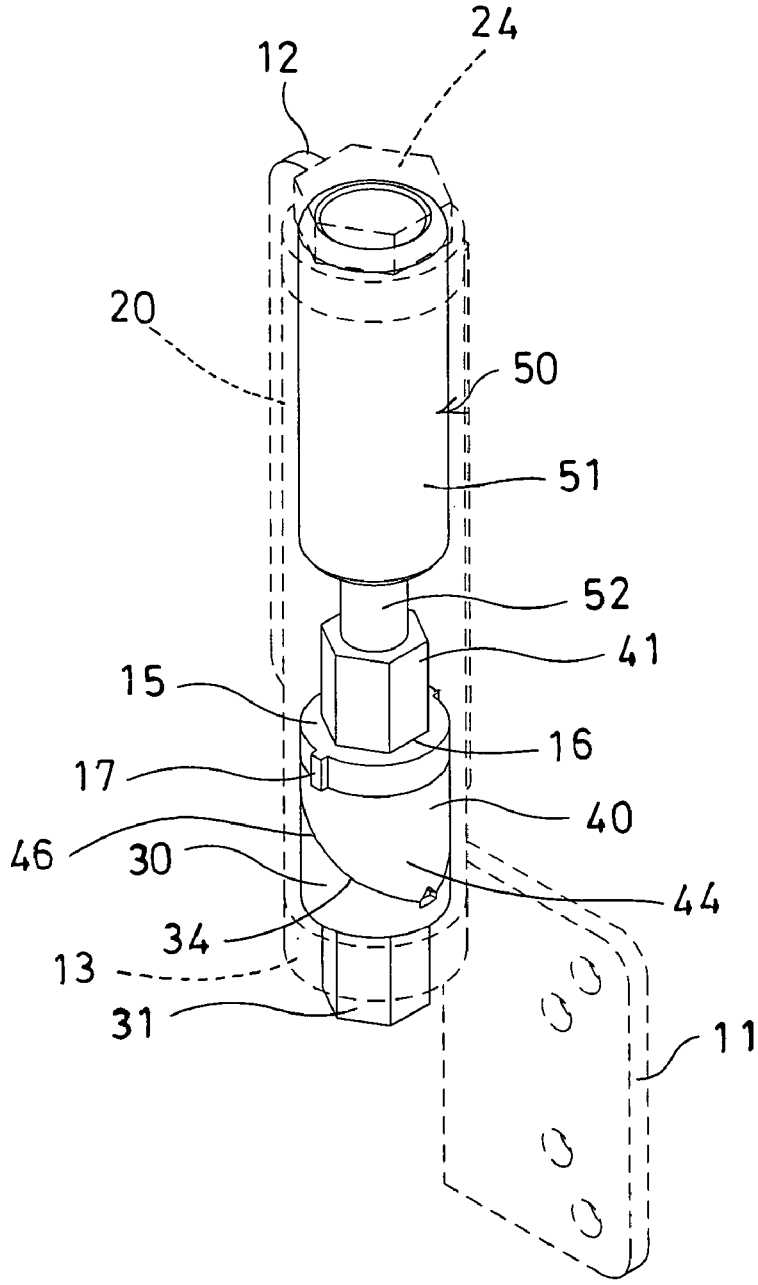
FIG. 4 is a perspective view similar to FIG. 2, in which an outer housing has been shown in dotted lines.

It is also preferable that the inclined surfaces 46 and 48 of the follower 40 and the protrusion 47 are inclined or facing toward different directions, and may have an included angle formed therebetween (FIGS. 3, 5, 9), for engaging with the inclined surfaces 34, 36 of the seat 30 and the swelling 35 of the seat 30 respectively (FIGS. 4, 5).

In operation, as shown in FIGS. 4 and 5, when the housing 20 and the flap 12 and the door panel 90 are rotated relative to the door frame 91 and the other flap 11 by the users, the anchor member 15 and the follower 40 may also be caused to rotate relative to the seat 30 and the base 13 and the flap 11 by the sliding engagement of the projections 17 of the anchor member 15 in the longitudinal grooves 22 of the housing 20. The follower 40 may then be caused to move upwardly away from the seat 30 and the base 13, from the position as shown in FIG. 4 toward the position as shown in FIG. 5, by the sliding engagement between the inclined surfaces 34, 46 of the seat 30 and the follower 40.

A recovering device 50 may be used to provide or to apply a spring biasing force against the follower 40, or to force the follower 40 toward the seat 30 until the inclined surfaces 34, 46 of the seat 30 and the follower 40 are engaged with each other again, and thus to force the follower 40 and thus the housing 20 and the door panel 90 to rotate relative to the door frame 91 and the other flap 11 back to the original position or the closed position as shown in FIG. 1, where the inclined surfaces 34, 46 of the seat 30 and the follower 40 are completely engaged with each other.

For example, as shown in FIGS. 3-8, the recovering device 50 may include a casing 51 secured in the housing 20 and rotated in concert with the housing 20, a rod 52 slidably and rotatably received in the casing 51 and having a threaded lower end 53 engageable into the passage 42 of the follower 40, and threaded with the inner thread 43 of the follower 40, to secure the rod 52 to the follower 40, and to allow the rod 52 to be moved up and down or in and out of the casing 51 by the follower 40.

The rod 52 includes a piston 54 secured on top thereof and slidably engaged in the inner chamber 55 of the casing 51, and one or more washers or gaskets 56 and one or more sealing rings 57 may be disposed or engaged in the lower portion of the casing 51, to slidably receive the rod 52, and to enclose the inner chamber 55 of the casing 51, and to allow the piston 54 to compress the air received in the upper portion of the chamber 55 of the casing 51, and to decrease the pressure or to generate a negative pressure in the lower portion of the chamber 55 of the casing 51, when the piston 54 is moved relative to the casing 51.

In operation, the follower 40 and thus the anchor member 15 may be caused to move upwardly relative to the housing 20 and to move away from the seat 30 and the base 13 when the housing 20 and the door panel 90 are rotated relative to the door frame 91, and the upward movement of the follower 40 may force the rod 52 and the piston 54 to move upwardly relative to the housing 20 and the casing 51, and the piston 54 may then compress the air received in the upper portion of the chamber 55 of the casing 51, and may decrease the pressure or may generate a negative pressure in the lower portion of the chamber 55 of the casing 51.

When the door panel 90 is released, the air pressure or the recovering force or the spring biasing force in the casing 51 or of the spring biasing or recovering device 50 may be formed as a forcing means to force the piston 54 and thus the rod 52 and the follower 40 to move downwardly relative to the housing 20 and the casing 51 automatically, or a forcing means for forcing the follower 40 and the housing 20 and the door panel 90 to rotate relative to the door frame 91 and the other flap 11 back to the original or closed position as shown in FIG. 1.

As shown in FIG. 5, when the door panel 90 and the follower 40 are rotated relative to the door frame 91 and the base 13 for a predetermined angle, such as about 90 degrees, the protrusion 47 of the follower 40 may be moved upwardly to top of the swelling 35 of the seat 30, and may be arranged to have a bottom portion 49 seated on an upper portion 39 of the swelling 35 of the seat 30, to allow the protrusion 47 of the follower 40 to be seated or supported on top of the swelling 35 of the seat 30, in order to stably retain the door panel 90 relative to the door frame 91 at the predetermined angular position or at the opening position.

The protrusion 47 of the follower 40 may be moved or rotated beyond the upper portion 39 of the swelling 35 of the seat 30 again, to allow the protrusion 47 and the follower 40 to move or to rotate downwardly relative to the swelling 35 and the seat 30 again when the door panel 90 and the follower 40 are forced to rotate relative to the door frame 91 and the base 13 again by the users, and the spring biasing or recovering device 50 may then force the piston 54 and the rod 52 and the follower 40 to move downwardly relative to the housing 20 and the casing 51 automatically, in order to force the follower 40 and the housing 20 and the door panel 90 to rotate relative to the door frame 91 and the other flap 11 back to the original or closed position.

The sliding engagement between the inclined surfaces 34, 46 of the seat 30 and the follower 40, and the sliding engagement between the inclined surfaces 36, 48 of the protrusion 47 of the follower 40 and the swelling 35 of the seat 30 may facilitate the downward movement of the seat 30 relative to the follower 40.

Accordingly, the door closing hinge device in accordance with the present invention includes an automatically returning or recovering structure having sliding engagements between sliding members, to facilitate the automatically closing of the door panel 90.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A door closing hinge device comprising:

a first flap and a second flap for attaching to a door frame and a door panel respectively, a seat attached to said first flap and including an inclined surface provided on top thereof, a housing attached to said second flap and including a chamber formed therein, a follower slidably disposed in said chamber of said housing, and including an inclined surface provided on bottom thereof, for engaging with said inclined surface of said seat, and for moving said follower up and down relative to said housing when said follower and said housing are rotated relative to said seat, means for guiding said follower to move up and down relative to said housing and to prevent said follower from being rotated relative to said housing, and means for forcing said follower and said housing and said door panel to rotate relative to said door frame and said first flap back to an original position where said inclined surfaces of said seat and said follower are engaged with each other, said forcing means including a casing secured in said housing, a rod slidably and rotatably received in said casing and having a lower end secured to said follower, to allow said rod to be moved up and down or in and out of said casing by said follower.

2. The door closing hinge device as claimed in claim 1, wherein said guiding means includes at least one groove formed in said housing, and includes at least one projection extended from said follower and slidably engaged in said at least one groove of said housing.

3. The door closing hinge device as claimed in claim 1, wherein said first flap includes a base attached thereto, and disposed and engaged with bottom of said housing, and arranged to allow said housing to be rotated relative to said base when said door panel is rotated relative to said door frame.

4. The door closing hinge device as claimed in claim 3, wherein said base includes a non-circular aperture formed therein, said seat includes a non-circular stem extended downwardly therefrom, engaged into said non-circular aperture of said base, to anchor said stem and said seat to said base and said first flap, and to prevent said seat from being rotated relative to said base and said first flap.

5. The door closing hinge device as claimed in claim 1, wherein said rod includes a piston secured on top thereof and slidably engaged in an inner chamber of said casing for pressing air received in said casing.

6. The door closing hinge device as claimed in claim 1, wherein said casing includes at least one gasket disposed therein, to enclose said inner chamber of said casing, and to slidably receive said rod.

7. A door closing hinge device comprising:

a first flap and a second flap for attaching to a door frame and a door panel respectively, a seat attached to said first flap and including an inclined surface provided on top thereof, a housing attached to said second flap and including a chamber formed therein, a follower slidably disposed in said chamber of said housing, and including an inclined surface provided on bottom thereof, for engaging with said inclined surface of said seat, and for moving said follower up and down relative to said housing when said follower and said housing are rotated relative to said seat, means for guiding said follower to move up and down relative to said housing and to prevent said follower from being rotated relative to said housing, said guiding means including at least one groove formed in said housing, and including at least one projection extended from said follower and slidably engaged in said at least one groove of said housing, said guiding means further including an anchor member slidably disposed in the housing and having said at least one projection extended therefrom, and said follower including a stem extended therefrom and engaged with said anchor member, to anchor said follower to said anchor member, and to allow said follower and said anchor member to be rotated in concert with each other, and means for forcing said follower and said housing and said door panel to rotate relative to said door frame and said first flap back to an original position where said inclined surfaces of said seat and said follower are engaged with each other.

8. The door closing hinge device as claimed in claim 7, wherein said anchor member includes a non-circular orifice formed therein, and said stem of said follower includes a non-circular cross section to engage into corresponding non-circular orifice of said anchor member, to anchor said follower to said anchor member.

9. A door closing hinge device comprising:

a first flap and a second flap for attaching to a door frame and a door panel respectively, a seat attached to said first flap and including an inclined surface provided on top thereof, said seat including a peripheral wall having a bore formed therein and having said inclined surface provided on top thereof, and including a swelling extended in said bore thereof and located within said peripheral wall thereof, a housing attached to said second flap and including a chamber formed therein a follower slidably disposed in said chamber of said housing, and including an inclined surface provided on bottom thereof, for engaging with said inclined surface of said seat, and for moving said follower up and down relative to said housing when said follower and said housing are rotated relative to said seat, and said follower including a peripheral wall having a bore formed therein and having said inclined surface provided on bottom thereof, and including a protrusion extended in said bore thereof and located within said peripheral wall thereof for engaging with said swelling of said seat, means for guiding said follower to move up and down relative to said housing and to prevent said follower from being rotated relative to said housing, and means for forcing said follower and said housing and said door panel to rotate relative to said door frame and said first flap back to an original position where said inclined surfaces of said seat and said follower are engaged with each other.

10. The door closing hinge device as claimed in claim 9, wherein said swelling of said seat includes an inclined surface provided on top thereof, and said protrusion of said follower also include an inclined surface provided on bottom thereof, for engaging with said inclined surface of said swelling of said seat.

* * * * *